United States Patent [19]

Timperi

[11] Patent Number: 4,971,519

[45] Date of Patent: Nov. 20, 1990

[54] METHOD AND APPARATUS FOR PUMPING HIGH CONSISTENCY MEDIUM

[75] Inventors: Jukka Timperi; Reijo Vesala, both of Kotka; Vesa Vikman, Kymi, all of Finland

[73] Assignee: A. Ahlstrom Corporation, Noormarkku, Finland

[21] Appl. No.: 366,699

[22] Filed: Jun. 15, 1989

[30] Foreign Application Priority Data

Jun. 17, 1988 [FI] Finland ..... 882903

[51] Int. Cl.[5] ..... E04D 1/10; B01D 19/00

[52] U.S. Cl. ..... 415/1; 55/203; 55/406; 415/143

[58] Field of Search ..... 415/143, 169.1, 1; 209/211; 210/512.1; 55/203, 406

[56] References Cited

U.S. PATENT DOCUMENTS

| | | | |
|---|---|---|---|
| 3,741,531 | 6/1973 | Chaplygin et al. | 415/143 |
| 4,019,829 | 4/1977 | Knopfel et al. | 415/143 |
| 4,326,863 | 4/1982 | Day et al. | 55/203 |
| 4,410,337 | 10/1983 | Gullichsen et al. | 55/52 |
| 4,435,193 | 3/1984 | Gullichsen et al. | 55/203 |
| 4,675,033 | 6/1987 | Fellman et al. | 55/203 |
| 4,776,758 | 10/1988 | Gullichsen | 415/169.1 |
| 4,826,398 | 5/1989 | Gullichsen | 415/143 |
| 4,834,547 | 5/1989 | Niskanen | 55/203 |
| 4,842,479 | 6/1989 | Dorsch | 415/143 |
| 4,854,819 | 8/1989 | Gullichsen | 415/143 |

*Primary Examiner*—Edward K. Look
*Assistant Examiner*—Hoang Nguyen
*Attorney, Agent, or Firm*—Cohen, Pontani & Lieberman

[57] ABSTRACT

A method of pumping high consistency pulp in form of a plurality of lumps in a pulp and gas containing space with a centrifugal pump having a suction opening communicating with said pulp containing space and a rotor extending through the suction opening into the pulp space including fluidizing the high consistency pulp by the rotating action of the pump rotor; and thereby forming a continuous fluidized pulp containing zone in form of a liquid lock in front of and around the suction opening of the pulp so as to substantially limit the suction action of the pump to the fluidized pulp containing zone and to prevent the gas from flowing in between and past the pulp lumps toward the suction opening. The centrifugal pump for attachment to the wall of the pump containing vessel includes a housing having a suction opening for connection to the wall of the pulp containing vessel and a discharge opening; and an impeller mounted for rotation with the housing, the impeller including a rear plate, at least one pumping vane attached to the rear plate, and a rotor projecting from the impeller toward the suction opening of the pump, the rotor includes at least one blade extending from the impeller through the suction opening beyond the wall of the pulp containing vessel and into the pulp containing vessel by a distance at least equal to the diameter of the suction opening.

15 Claims, 2 Drawing Sheets

METHOD AND APPARATUS FOR PUMPING HIGH CONSISTENCY MEDIUM

BACKGROUND OF THE INVENTION

The present invention relates to an improved method and apparatus for pumping media which are relatively thick or clotted or contain air, i.e. liquids or various kinds of suspensions. The method and apparatus in accordance with the present invention are especially suitable for pumping medium consistency (8 to 20%) or high consistency (over 20%) fiber suspensions of the pulp and paper industry. The method part of the invention especially relates to a method of eliminating or minimizing the disadvantages caused by air and/or gases in the medium or which are absorbed by the medium. The apparatus part of the present invention especially relates to the structure of an impeller for use in a centrifugal pump.

There are several known centrifugal pumps that have been used and are still being used in the wood processing industry for pumping fiber suspensions. The largest group is basically formed by conventional centrifugal pumps, which are somewhat modified by non-essential changes, to enable the pumping of pulp therewith. An example of this type of change is the installation of inducers in front of the actual impeller to facilitate the flow of pulp to the impeller of the pump itself. In spite of a number of attempts and minor structural changes it has not been possible to use the above described pumps for the pumping of pulp, having a consistency exceeding 6–8%. This is due to both an increase of the gas content of the pulp simultaneously with an increase of the consistency thereof, whereby the air or gas bubble accumulated at the center of the impeller prevents the pulp from effectively contacting the impeller as well as due to poor flow-ability of the high consistency pulp within the suction duct of the pump or from the pulp containing chamber to the suction duct of the pump.

The next stage in the late 1970s is governed by the so-called MC$^{TM}$ - pump (MC =medium consistency), which is characterized in that a rotor is mounted in the suction opening of the pump and extends through the suction duct to a short extent inside the mass tower, drop leg or the like. The rotor is used for loosening the bonds between fibers of the suspension by feeding energy in the form of a field of shear forces to the pulp, whereby the pulp flows more easily to the impeller of the pump. The object with these pumps was to achieve the ability to pump pulps having a consistency of 8 to 15%. The main problem encountered with this kind of medium consistency pulp appeared to be the poor flow-ability of the pulp in the suction duct of the pump and consequently, the invention was aimed at facilitating the pulp flow to the impeller within the flow duct. Various embodiments of such pumps are illustrated, for example, in the specifications of U.S. Pat. Nos. 4,410,337, 4,435,193 and 4,637,779. In these embodiments the pulp being pumped is both fluidized and the gas, mostly air, which is harmful in the further processing of the pulp and in the pumping thereof is discharged. The fluidization is carried out by rotor blades mounted inside a relatively long suction duct of the pump, the blades being substantially located in radial planes and extend axially, although in some embodiments helically wound rotor blades are also to some extent used. The accumulation of gas at the hollow center of the rotor takes place in all illustrated embodiments in front of the impeller due to centrifugal force, wherefrom the gas is further discharged through the openings in the rear plate of the impeller most commonly by means of the suction created by a vacuum pump.

Regarding the structural details of the MC-pumps in the prior art it is noted that the rotor in all embodiments extends to some extent into the pulp containing space. A detailed description thereof is provided in the most recent publication, U.S. 4,637,779, in which the rotor is described to be extending into said space by a distance of about 3 inches, in other words of about 75 mm. This distance is actually the maximum distance, as most of the production pumps include a rotor which does not extend that far into the pulp containing chamber. The maximum dimension is thus at most about one-half times the diameter of the suction duct, i.e. the ratio decreases in reality as the diameter of the suction duct increases. In practice the suction duct of even the smallest MC-pump has a diameter of about 150 mm resulting in the above relation. However, when the diameter of the suction duct is increased the actual distance of the extension of the rotor into the pulp chamber remains substantially the same.

Initial development of the MC-pumps was based on the assumption that the fundamental problem for pumping high consistency pulp was to overcome the friction present between the pulp and the wall of the suction duct. Accordingly attempts were made to eliminate the friction by fluidizing the pulp in the suction duct. A second problem appeared to be the discharge or transfer of pulp from the vacuum chamber or from the drop leg to the suction duct, because high consistency pulp tends to gradually fill openings surrounded by sharp edges, in other words, the suction opening of the pump. This theory resulted in the extension of the fluidizing rotor to reach to some extent to the inside of the pulp chamber to allow the rotor to remove the fibers and fiber particles stuck to the edges of the suction duct and to prevent the clogging of the suction opening. However, the prior art maintained the theory that the flow of the material being pumped should be as laminar as possible when reaching the pump so as to avoid losses in flow, e.g. pressure loss. Reference thereof may still be found, for example, in the above-mentioned U.S. patent specification 4,637,779, in which at column 2, lines 24–30 it is stated that an apparatus in accordance with the prior art technique generates in front of the suction opening of the pump and around it a "doughnut"-shaped, turbulent, at least partly fluidized, zone which is located in close proximity to the edges of the pump. In accordance with the former theory this U.S. patent specification comes to the conclusion that the described phenomenon disturbs the pumping and, therefore, the ends of the rotor blades extending into the mass tower or the like are bent so as to subject the pulp to a force component which is directed towards the suction opening of the pump. According to the specification this solution is based on the fact that it is possible to apply or exert pressure onto the inflowing pulp, thus also facilitating the discharge of gas from the front side of the impeller of the pump.

Because the disclosed pumps have never entered the market there is good reason to doubt the operation of the described apparatus as well as the exactness of the above-mentioned conclusions at least as they relate to the higher end of the 6 to 20% consistency range mentioned in the specification. In fact, it is believed that in the embodiment shown in said U.S. patent a hollow arch-like space is readily formed in the pulp at higher pulp consistencies in front of the ends of the rotor blades because the intent is especially to prevent the circulation of the pulp in the pulp vessel. In other words, the pulp is drawn as discretely as possible directly from the vessel to the pump. This problem is, however, encountered only with pulp having a consistency of 10 to 15% depending on the physical and chemical qualities of the pulp.

Accordingly, when pumping pulp with MC-pumps and even at a consistency lower than medium consistency and although the pump and rotor are able to efficiently treat the pulp in the suction duct and immediate vicinity thereof, the problem appears to be based on the poor transfer of pulp from the mass tower or the like to the suction duct of the pump. The bases of this problem are two fold: first, the arching of pulp in the pulp space, in other words, the formation of an empty arch-like space in front of the suction opening of the pump and, second, the friction between the pulp and the walls of said space which slows down the downward flow of the pulp.

It has been noted in the experiments performed that an especially efficient method of preventing the arching of the pulp and reducing the friction between the pulp and the wall of the pulp space is to impart a circulating movement to the pulp in the pulp vessel. This kind of circulating movement may generate enough turbulence in the pulp layer close to the wall of the pulp space so that small pulp particles are generated when larger pulp particles are broken, and the small particles act in a way as bearing balls between the pulp and the wall, whereby the friction between the pulp and the vessel wall is decreased and the pulp will flow downwards faster and easier.

When pumping experiments have been performed with an MC-pump in accordance with the prior art simulating the mill conditions it has been noted that gas will flow through the lumpy pulp in the pulp space to the suction opening of the pump, which has, as already mentioned above, a "doughnut-shaped" fluidized ring along the edges thereof and which also has, in a certain way, an open center part, whereby the lumpy pulp may be directly subjected to the suction of the pump and the gas discharge system thereof and even to the air space in the upper part of the pulp containing space. Accordingly gas will flow both from the many spaces between the pulp lumps and, in the case of a very high consistency pulp also from the upper part of the pulp container, the air space, to the pump.

The reason this phenomenon has not been observed before is partly due to, on one hand, that only small amounts of air and, on the other hand, that pulp containing only small particles have been pumped in the tests with the pulp having a consistency not above 15%, whereby the air spaces between the pulp particles are small and they do not reach the surface of the pulp space. Said problem occurs only at the stage when the amount of free water (water not absorbed in the fibers) in the pulp is decreased to a point so low that it does not have time to filter to the bottom part of the mass tower or the like to form a layer of water and pulp lumps there. No definite consistency limit or the like may be given as to the appearance of said problem, because it depends on many factors such, for example, as the consistency of the pulp itself, the length of the fibers of the pulp, the speed at which the pulp flows downwards in the tower, etc. The problem, however, appears soon after the consistency of about 10% is exceeded.

When experiments simulating the mill conditions have been performed with the pump in accordance with the present invention, it has been noted that when the rotor of the pump has been extended far enough into the suction chamber and especially when the end of the rotor has been provided with foils intensifying the circulating flow heavily criticized, for example in U.S. Pat. specification No. 4,637,779, the amount of gas removed by the pump from the medium is substantially reduced.

SUMMARY OF THE INVENTION

In order to eliminate or minimize the disadvantage of the prior art MC-pumps a new type of rotor arrangement for a centrifugal pump has been developed. The rotor arrangement fluidizes the pulp as in the earlier MC-pumps, but the arrangement enlarges the fluidization field to further extend into the suction chamber. The embodiment of the present invention is further characterized in that the flow surface area of the suction opening of the pump remains as open as possible thus allowing the pulp to flow also through the center part of the suction opening towards the impeller, whereby maximal efficiency is gained of said flow surface area.

Accordingly, an embodiment of a rotor in accordance with the present invention is provided with special blades which throw the pulp radially outwards and which, when located far enough from the inlet end of the suction duct, do not substantially reduce the amount of pulp flowing into the suction duct, but only ensure that the supply of pulp coming to the rotor for fluidization remains continuous and sufficient.

The pulp is subjected to a powerful and widely extending field of shear forces by the rotor in accordance with the present invention. The rotor may also be provided with auxiliary blades which extends far into the suction chamber so that the portion of pulp in the chamber surrounding the entire head of the rotor and the suction opening will be fluidized, whereby the suction action of both the pump and also the gas discharge system is directed solely to the fluidized pulp and not to either the air cavities between the pulp lumps and/or to the air space in the upper part of the pulp containing chamber. The shape of the fluidized area so generated may be described as apple-shaped, whereby the suction opening of the pump is surrounded by a large fluidized pulp zone, which is completely shielded from gases.

The operation of the method in accordance with the present invention is thus based on the fact that pulp flow is circulated in the pulp vessel around the suction opening by the pump rotor extending far enough inside the pulp containing chamber so that a large fluidized pulp zone, practically acting like water, is formed there, and which zone prevents exterior gas which is not bound to the fibers from entering the suction duct of the pump. The circulating fluidized pulp flow tends to break up the pulp lumps, whereby the gas present between the lumps will move upwards and will be discharged from the upper part of the chamber. Thus the only gas, which will flow into the pump is the gas which adheres to the fibers as micro bubbles, and which is separated by utilizing the centrifugal force in the suction duct of the pump in front of the impeller.

The method in accordance with the present invention includes preventing the gas present in the cavities between the pulp lumps in the pulp containing space or in the upper part of the pulp containing space to flow along the cavities or spaces between the pulp lumps to the suction opening of the pump by forming a liquid lock, such as a continuous fluidized pulp zone, in front of the suction opening of the pump, whereby the suction action of the pump is directed essentially solely to said zone.

The apparatus in accordance with the present invention is characterized in that the distance between the tips of the blades of the rotor projecting from the impeller, and the suction opening in the side wall of the pulp containing space is at least equal to the diameter of said suction opening.

BRIEF DESCRIPTION OF THE DRAWINGS

The method and apparatus in accordance with the present invention is described more in detail below by way of example with reference to the accompanying drawings, in which.

DETAILED DESCRIPTION OF THE PRESENTLY PREFERRED EMBODIMENTS

Figure 1:
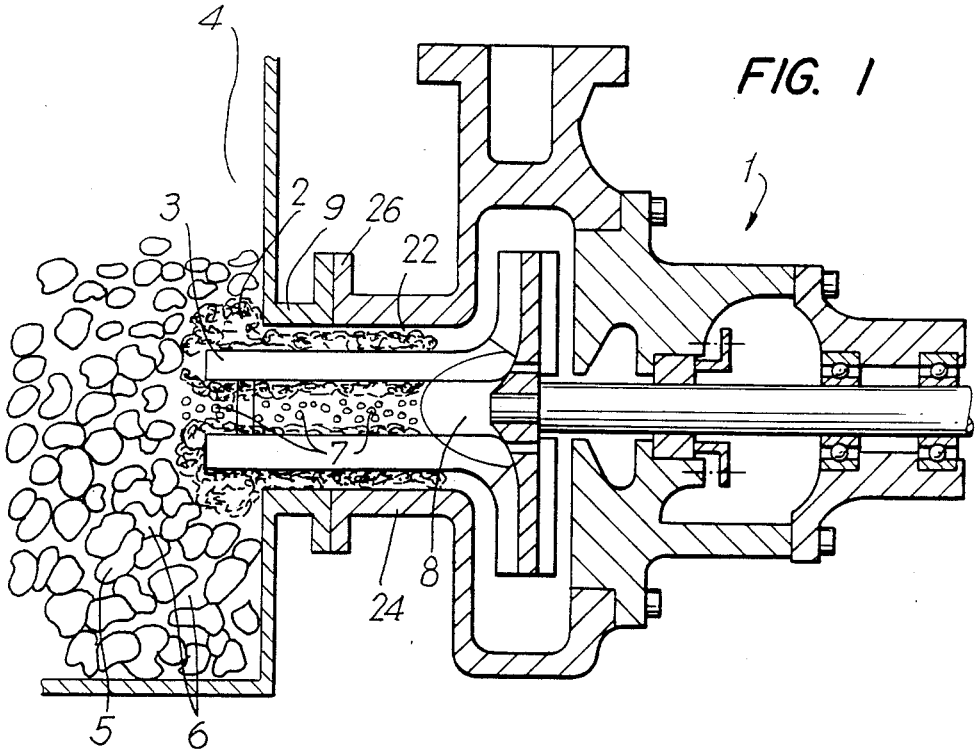
FIG. 1 is a sectional side view of a prior art MC-pump and a fluidized pulp zone generated thereby.

FIG. 1 shows that a zone 2 of fluidized pulp generated by a prior art MC-pump 1 which zone essentially surrounds rotor blades 3 and extends only to a very restricted annular area proximate the tips of blades 3 of the rotor. Thus, lumps of pulp 5 remain in the pulp space 4 or in the immediate vicinity of the rotor, which pulp lumps have air/gas spaces or channels 6 therebetween through which the suction of the pump will draw gas 7 directly into the pump generating a gas bubble 8 in known manner in front of the impeller thereof. Design and use of the prior art apparatus is based on the fact that previously the only problem which was considered was the transfer of the pulp from the suction duct to the pump, and according to previous thinking it was considered to be a waste of energy and contrary to the earlier understanding of design guidelines for centrifugal pumps to further extend the rotor into the suction chamber and attempt to fluidize the pulp without any particular apparent reason. By only slightly extending the rotor beyond the suction opening into the pulp containing chamber it was intended to ensure that fibers or pulp particles were unable to cling to the edges of the suction opening and thus contribute to the gradual clogging thereof.

Figure 2:
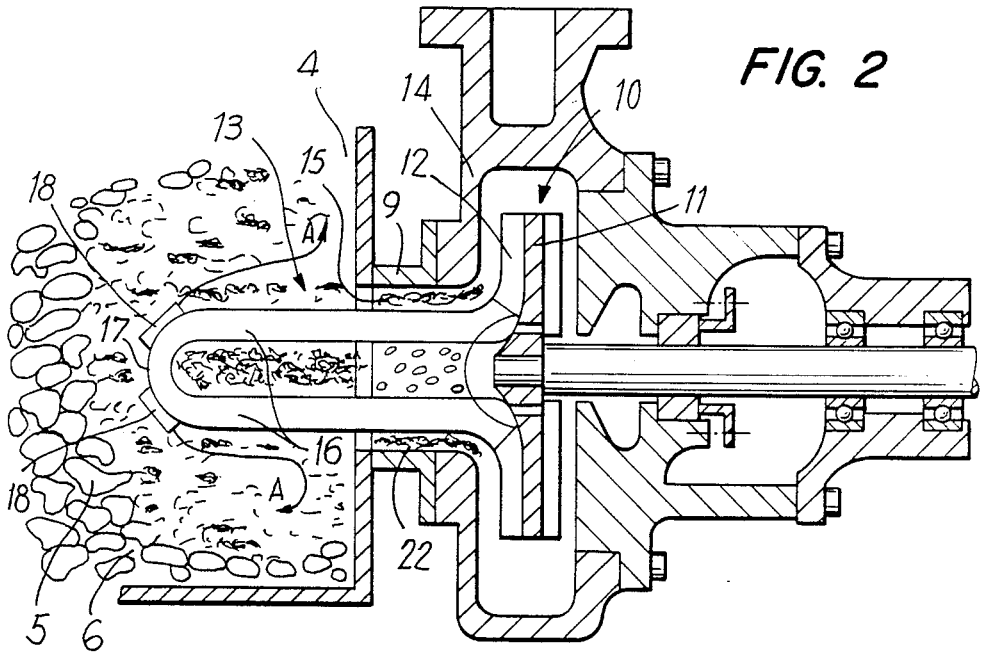
FIG. 2 is a sectional side view of an embodiment in accordance with the present invention together with an auxiliary device and a fluidized pulp zone generated thereby.

FIG. 2 illustrates an impeller 10 of a centrifugal pump in accordance with an embodiment of the present invention, which comprises a rear plate 11 with pumping vanes 12 and a rotor 13 mounted thereto. As is seen in the drawing, impeller 10 is located in the housing 14 of the centrifugal pump so that rotor 13 extends a substantial distance beyond the suction opening 15 of the pump and into the pulp containing space 4. Experiments have shown that the rotor should extend into the pulp containing space 4 for at least a distance equal to the diameter of suction opening 15 before the advantages described herein are gained by the present invention. The distance of how far the rotor is to extend into the pulp containing vessel is measured from a point at the pulp vessel walls which permits the desired effects including fluidization and circulation of the fluidized pulp. Thus, the preferred embodiment as described below provides for a pulp containing space having a rather flat contour around the suction opening and may have a shortened suction duct or no suction duct at all. If, however, either a suction duct is used in connection with the pump or the pulp containing vessel has a similarly tapered neck or outlet conduit as in U.S. Pat. No. 4,780,053 it is understood that the distance of how far the rotor should extend into the pulp containing zone is measured from a point at which the pulp containing vessel walls diverge so that the desired functions including fluidization and circulation of the fluidized pulp can be effected as described in more detail below.

One advantageous alternative to arrange rotor 13 to extend further into the space containing the material to be pumped is to shorten suction duct 22 of the pump. The suction duct 22 in the prior art arrangements always consists of two parts, namely an annular opening, which is an integral part of the pump housing and which is conventionally surrounded by a cylindrical part 24, a so-called suction neck having flange 26 mounted thereto. A suction pipe 9 is provided for attachment, for example, to the wall of the mass tower, and to which pipe the pump is mounted with flange 26. It has now been found that the cylindrical part 24 surrounding the annular opening of the pump can almost be completely removed so that mounting holes (not shown) are arranged directly in the pump housing 14 for mounting the pump to the wall of the mass tower via suction pipe 9. Thus, the production of the pump is simplified because there is no need for the provision of a cylindrical suction duct 24 projecting from the housing of the pump and ending in flange 26. Further, in some situations it is also possible to omit the suction pipe 9 altogether, for example, when the pump is mounted to the bottom of a mass tower or a drop leg and when the discharge opening of the pump is pointing to the side. The pump is then mounted directly with its housing to the mass tower, whereby one conventionally utilized connecting piece has been eliminated.

Figure 3:
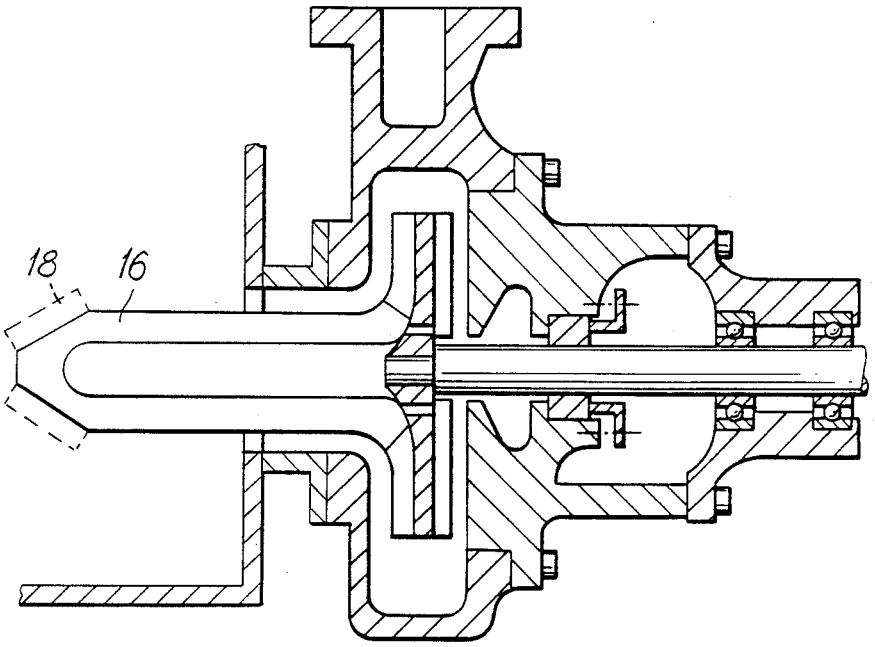
FIG. 3 is a sectional side view of a second embodiment of the apparatus in accordance with the present invention.

Rotor 13 of the impeller of the centrifugal pump in accordance with the present invention comprises blades 16 projecting from rear plate 11 of the impeller to the suction duct 15 of the pump. Blades 16 are preferably, but not necessarily, extensions of the actual pumping vanes 12, for example, in such a way that if the impeller has a total of six vanes, three of the vanes extend as blades 16 of rotor 13 through suction duct 15 into the pulp containing space 4. Blades 16 of rotor 13 are mounted substantially axially within the suction duct and preferably extend from the axis outwardly in radial planes. In some cases it is, however, necessary to deviate the position of the blades from the above described axial arrangement, if, for example, it is desired to gently feed the pulp to the pump impeller. Equally, the blades may be positioned other than in a radial direction, for example, when it is desired to feed pulp toward the center space of the blades. According to FIGS. 2–4 blades 16 of the rotor 13 extend deeply into the pulp containing space 4 and are connected to each other at the tips thereof by a connecting member so that the terminal or end part 17 of the rotor during rotation thereof will form a conical or rotationally paraboloidal or the like surface. The purpose of connecting the rotor blades is to prevent the pulp particles from attaching to the end parts or tips of the rotor blades. The end part 17 of rotor 13, at which point the blades are joined together, may be closed, as shown in FIG. 2, thereby preventing the axial flow of pulp in the area within the rotational radius of the blades 16 of rotor 13. On the other hand, blades 16 of rotor 13 may be joined together so that the tips of the joined blades form a star (FIG. 3), which arrangement permits the axial flow of pulp except within the area closest to the axis of the rotor. The blades may also be joined along a definite length thereof or even along the entire length of the blades either directly to each other or by means of an axial connecting piece.

Figure 4:
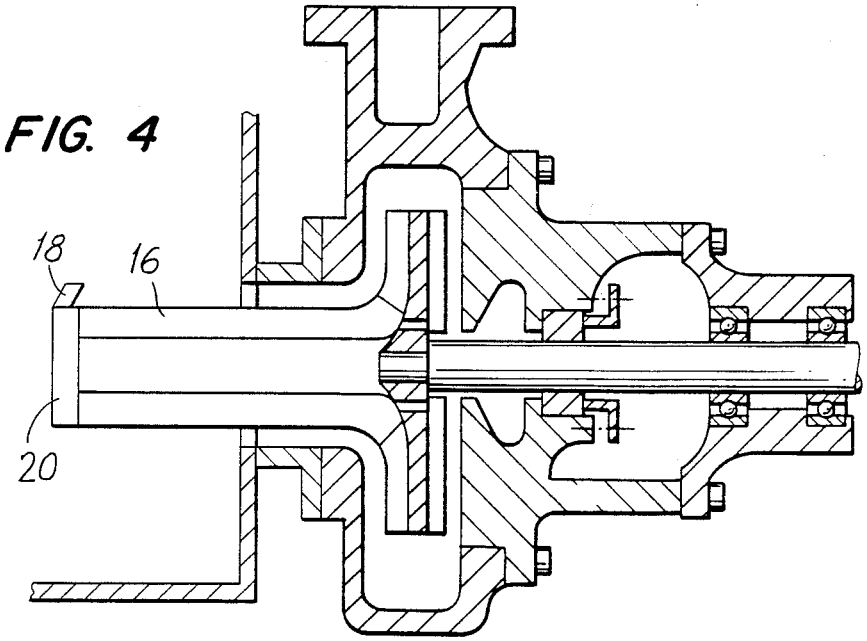
FIG. 4 is a sectional side view of a third embodiment of the apparatus in accordance with the present invention.

FIG. 4 illustrates as a third embodiment, in which blades 16 of rotor 13 are connected to each other by a substantially annular or the like member forming a continuous rim or band 20 which may be attached at any diameter defined by blades 16 of rotor 13 or also mounted by means of an interim member to the outer or inner edges of blades 16, if so desired. The term "substantially annular" is meant to include any shape in which a free center space is surrounded by a continuous rim or band and includes circles, ovals and angular shapes with three or more corners. Providing a connecting arrangement with a center opening permits the flow of pulp towards the suction duct of the pump also along the center-line of the rotor. More than one connecting member may also be provided along the length of rotor 13. Similarly, the connecting member does not necessarily have to be located in the area near the tip of the rotor, but may, preferably, be located at some distance from the tips of the blades towards the impeller depending on the strength of materials.

When the rotor extends into the pulp space beyond a certain distance, which varies from case to case and which may be easily experimentally determined, the particular shape or connecting method of the end parts of the blades is of less importance. This is due to the fact that after the pulp has passed the terminal part of the rotor the pulp has sufficient space and time to flow through the openings between blades 16 of rotor 13 to the area inside the rotor, whereby the entire cross-sectional area of the rotor is efficiently utilized, which is not the case in the prior art MC-pump structures. This complete utilization of the cross-sectional area or more precisely the transfer of pulp to the center of the pump inlet may be intensified by bending the blades of the rotor slightly inwards thus creating a drawing effect in the area between the tip of the rotor and the front part of the suction opening, thereby ensuring that the center part of the rotor is filled with pulp suspension. In this type of embodiment the outer axial edge of the rotor blades is bent slightly towards the rotational direction of the rotor, whereby the material being pumped is subjected by the blades to a radial force component directed toward the axis of the rotor.

FIG. 2 also illustrates special auxiliary blades 18 for causing the pulp to circulate within the pulp container. In the embodiment shown in the drawing auxiliary blades 18 are mounted to the connecting member joining blades 16 of rotor 13. The direction of the auxiliary blades 18 is chosen so that a strong radial motional component is created in the pulp, thus causing the pulp to move along the walls of the tower as is shown in FIG. 2 by arrows A. The non-fluidized pulp in the center of the tower will quickly move downwards and into the fluidization zone of the rotor which extends a substantial distance into the pulp containing space, whereby a part of the pulp will flow inside the rotor blades and thus into the suction duct of the pump while another part of the pulp is directed back to the circulation path. The pulp circulation effect is especially strong at the bottom part of the pulp containing space, in which part normally a zone of standing pulp tends to accumulate. The pulp circulating at the bottom part of the container creates, relatively speaking, a stronger turbulence than at other parts of the pulp space due to the smaller mass volume to which the circulation effect is directed. The embodiments of FIGS. 3 and 4 may also be provided with one or more radial pumping blades, for example, in the embodiment of FIG. 3 by bending the tips of the blades of the rotor radially or by adding a separate blade to each blade tip to improve radial pumping. For example, in the embodiment shown in FIG. 4, one or more radial blades may be attached either to the ring connecting the blade tips of the rotor or directly to the blade tips or by integrally connecting the auxiliary blades 18 to the blade tips already at the casting stage. It is understood that auxiliary blades 18 may extend radially for a distance beyond the diameter than blades 16 of the rotor or they may also be located very close to the axial line of the rotor if so desired. Design parameters are easily determined e.g. on the basis how strong a circulation effect is desired in the pulp space.

In another embodiment of the present invention, the blades in the area of the outer end or tip part of the rotor are substantially axial, in other words, they do not draw pulp into the pump inlet as the prior art pumps described in U.S. Pat. No. 4,637,779. These prior art arrangements, as mentioned, cause an empty or hollow arch-like pulp space in front of the rotor. When the tips of the blades extend in axial direction, they tend firstly to fluidize the lumpy pulp more effectively and, secondly, bring about an effect which is almost in itself sufficient to circulate the pulp. Closer to the suction duct the blades are bent to form an angled position with the axial direction subjecting the pulp to a gentle feeding effect which will move the pulp towards the pump.

In tests performed by applicants it has been shown that a centrifugal pump provided with an impeller in accordance with the present invention is able to pump pulp which has a 5% higher consistency than is possible to pump with a prior art centrifugal pump, the economic field of use of which has been limited to pulp having a consistency considerably below 20%, which, however, is exceeded by the pump in accordance with the present invention. In addition, if the pulp with the consistency of below 20% is being pumped with the pump of the present invention, the energy consumption of the pump is lower, in other words, the efficiency of the pump is considerably increased due to a more open suction duct and due to the particular physical nature of the pulp which is very efficiently fluidized already in the pulp containing space and also due to the fact that practically speaking, substantially no gas is drawn to the pump from the pulp spaces or cavities between the lumps of pulp.

It has also been shown in the tests, and illustrated above, that the amount of discharged gas is considerably and significantly lower than with the prior art MC-pumps. The reason therefor, as already mentioned above, is that such an intensive fluidization is carried out in the pulp containing space that no or hardly any non-fluidized lumpy pulp remains in front of the center of the rotor of the pump. Thus, gas is prevented to flow from the upper part of the pulp space towards the pump along the spaces or cavities between the pulp lumps. Accordingly, a "liquid lock" is formed by the fluidized pulp in front of and around the suction opening of the pump, which "liquid lock" prevents the gas to enter the pump inlet. This is similar to the pumping of low consistency pulps when liquid has been allowed to filter and move to the bottom of the pulp containing space, so that when the level of the liquid layer is above the suction opening of the pump no gas discharge problems occur.

As it may be observed from the above description a novel method and apparatus has been developed for pumping medium and high consistency pulp. The apparatus is characterized by the rotor arrangement as illustrated above in a number of embodiments and alternatives. The scope of invention is, however, not restricted to the above described preferred structural solutions, the purpose of which is merely to show exemplary different alternatives for the realization of the present invention. Thus, the scope of the invention is restricted only by what is set forth in the accompanying claims. Accordingly, if desired a degassing vacuum pump may be provided and mounted on the same shaft with the impeller or in particularly preferred situations it may be entirely omitted. Further, the arrangement in accordance with the present invention permits the shortening or lowering of the drop leg or mass tower due to the discharge of the mass tower having become more reliable by efficiently preventing the pulp from arching in the tower in front of the suction opening of the pump. Finally, although the pump in each of the drawings has been shown with its shaft in a horizontal position, it is, in some cases, advantageous to arrange the pump in a different position, whereby the shaft may be either in an inclined position or even vertically positioned. Also in some special situations the pump may be located above the pulp space in a hanging position relative to the motor.

What is claimed is:

1. A method of pumping high consistency pulp forming a plurality of lumps in a pulp and gas containing space with a centrifugal pump having a suction opening communicating with said pulp containing space, said method comprising:

placing a rotor within said suction opening;

providing at said rotor at least one blade which extends beyond the wall of said pulp containing space and into said pulp containing space by a distance which is at least equal to the diameter of said suction opening;

fluidizing said high consistency pulp by the rotating action of said rotor; and thereby forming a continuous fluidized pulp containing zone in form of a liquid lock in front of and around said suction opening of said pump so as to substantially limit the suction action of said pump to said fluidized pulp containing zone and to prevent said gas from flowing in between and past said pulp lumps towards said suction opening.

2. The method of claim 1, wherein said liquid lock and fluidized pulp containing zone is formed by subjecting said pulp lumps to a field of shear-forces; and by comminuting said pulp lumps within said pulp space thereby densifying said pulp and liberating said gas and permitting said gas to flow upwards within said pulp containing space away from said suction opening.

3. The method of claim 1, wherein said fluidized pulp containing zone is formed by subjecting said pulp to a circulating movement in front of and around said suction opening thereby surrounding said suction opening with fluidized pulp substantially acting like a liquid.

4. The method of claim 1, wherein said fluidized pulp is pumped without discharging gas from said pulp being pumped.

5. The method of claim 1, additionally comprising the steps of:

separating gas from said fluidized pump within the suction duct of said pump; and discharging said separated gas from said pump by the pressure of the suction duct.

6. A centrifugal pump for attachment to the wall of a pulp containing vessel comprising:

a housing having a suction opening for connection to said wall and a discharge opening therein; and an impeller mounted for rotation within said housing, said impeller comprising a rear plate; at least one pumping vane attached to said rear plate; and a rotor projecting from said impeller toward said suction opening; said rotor comprising at least one blade extending beyond said wall of said pulp containing vessel and into said pulp containing vessel by a distance at least equal to the diameter of said suction opening.

7. The centrifugal pump of claim 6, additionally comprising means attached to said blades of said rotor for interconnecting said blades; said connecting means being located at a distance from said wall at least equal to the diameter of said suction opening of said pump.

8. The centrifugal pump of claim 6, additionally comprising auxiliary blades mounted at the end of said rotor extending into said pulp space for forcing said pulp to move in a radial direction, for imparting a circulating movement to said pulp in said pulp containing vessel and for fluidizing said pulp proximate said end of said rotor.

9. The centrifugal pump of claim 6, wherein said connecting means comprises a substantially annular continuous band defining an aperture for permitting said pulp to enter the center area of said rotor.

10. The centrifugal pump of claim 8, additionally comprising means for interconnecting said blades and wherein said connecting means is located at said end of said rotor extending into said pulp space and in communication with said auxiliary blades.

11. The centrifugal pump of claim 6, additionally comprising means on said pump housing for connecting said pump housing directly to said wall of said pulp containing space without intervening structure.

12. The centrifugal pump of claim 6, wherein said blades of said rotor are joined at the inner edges thereof.

13. The centrifugal pump of claim 6, additionally comprising means at said rotor for interconnecting said blades of said rotor.

14. The centrifugal pump of claim 6, wherein said blade has an edge at the end thereof, and said edge at the end of said blade is inclined relative to the axis of said rotor so as to cause fluidization of said pulp, to produce a circulating effect on said fluidized pulp and to generate an effect on said fluidized pulp so as to feed said pulp towards said suction opening and into said pump.

15. The centrifugal pump of claim 6, wherein said blade extends from said impeller through said suction opening.

* * * * *